US005165211A

United States Patent [19]

Ottoson

[11] Patent Number: 5,165,211

[45] Date of Patent: Nov. 24, 1992

[54] ALUMINUM COVERED POLYSTYRENE ROOF TILE AND METHOD OF APPLICATION TO A ROOF

[76] Inventor: James L. Ottoson, 150 CR 94, Palm Harbor, Fla. 34683

[21] Appl. No.: 717,613

[22] Filed: Jun. 19, 1991

[51] Int. Cl.[5] ..... E04D 1/28

[52] U.S. Cl. ..... 52/548; 52/556

[58] Field of Search ..... 52/543, 546, 518, 521, 52/531, 553, 478, 556, 541, 542, 520

[56] References Cited

U.S. PATENT DOCUMENTS

| | | | |
|---|---|---|---|
| 1,435,623 | 11/1922 | Saxe | 52/465 |
| 1,963,583 | 6/1934 | Jenkins | 52/456 |
| 2,231,008 | 2/1941 | Ochs | 52/556 |
| 2,264,546 | 12/1941 | Ochs | 52/541 |
| 2,522,067 | 9/1950 | Sperry | 52/420 |
| 2,879,555 | 3/1959 | Dubecky | 52/543 |
| 3,852,934 | 12/1974 | Kirkhuff | 52/556 |
| 3,875,715 | 4/1975 | Martin et al. | 52/309 |
| 4,120,132 | 10/1978 | Kendrick | 52/478 |
| 4,399,643 | 8/1983 | Hafner | 52/543 |
| 4,445,305 | 5/1984 | Orie, Sr. | 52/309.9 |
| 4,499,645 | 2/1985 | Luomanen | 29/445 |
| 4,575,981 | 3/1986 | Porter | 52/309.9 |
| 4,741,131 | 5/1988 | Parker | 52/15 |

OTHER PUBLICATIONS

Pen ®Plast Bermuda Roof Tile brochure of nine paages.

*Primary Examiner*—James L. Ridgill, Jr.
*Attorney, Agent, or Firm*—Herbert W. Larson

[57] ABSTRACT

A tapered polystyrene core having a front nose portion and rear edge covered with sheet aluminum. The rear edge has an L-shaped aluminum leg which snaps into a U-shaped locking flange screwed in place over a top surface of an abutting nose portion of another tile. Gasket tape is laid over seams between adjacent horizontal panels and a metal plate is screwed in place to make a water tight seal. Each rear edge of a panel has a notch for receiving the nose of an adjacent tile in a vertical configuration rising upward toward the peak of a roof.

5 Claims, 6 Drawing Sheets 10A
22
36
38
40

10
20
22
30
12
14
54
56
58
16
18

10
12
22
30
32
34
16
34

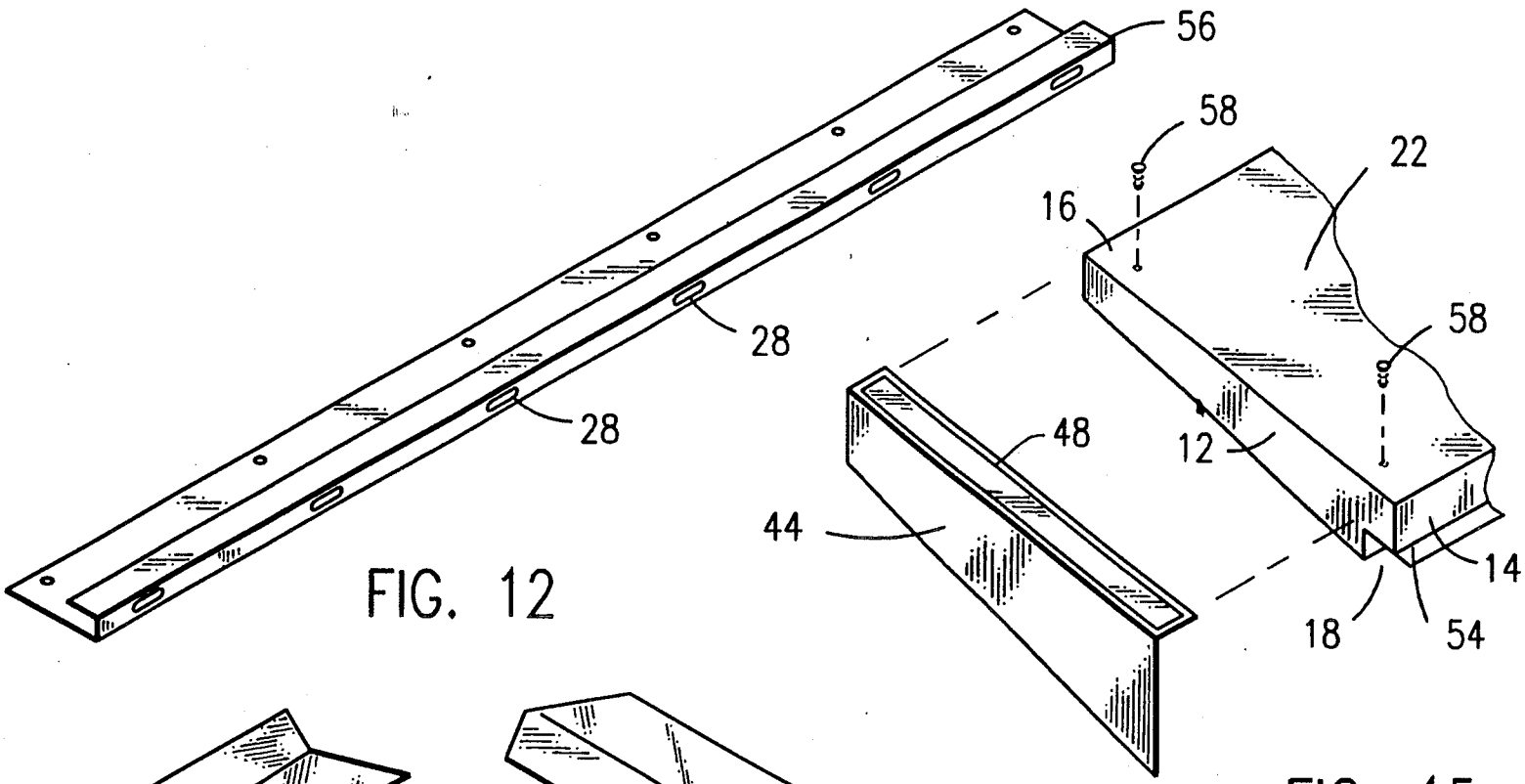
FIG. 12
FIG. 15
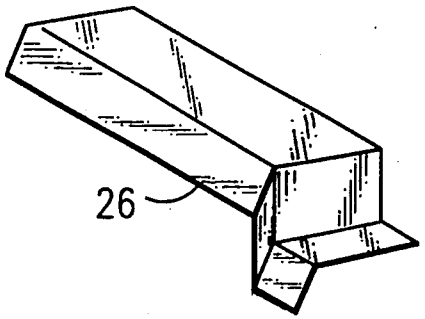
FIG. 14
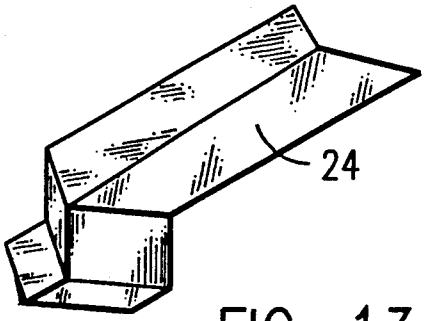
FIG. 13

ALUMINUM COVERED POLYSTYRENE ROOF TILE AND METHOD OF APPLICATION TO A ROOF

BACKGROUND OF THE INVENTION

1. Field of The Invention

This invention relates to roof tiles. More particularly, it refers to an insulating roof system for installation over an existing pitched roof.

2. Description of the Prior Art

Secondary roofing materials made from polystyrene and coated with a cement like layer have been well known in the roofing industry for their insulating qualities for at least twenty years. Unfortunately, such coated polystyrene tiles will often crack after a few years exposure to the elements and give the roof an unsightly appearance. In addition, roofing panels have previously been made from polystyrene or polyurethane overlapped with a metal sheet such as aluminum. See U.S. Pat. Nos. 3,875,715; 4,445,305 and 4,499,645. However, these prior art panels have been difficult to bond to a pitched roof without fear of wind damage. A roofing tile providing substantial insulation, ease of installation and strongly bonded to the roof to prevent wind driven damage is needed.

SUMMARY OF THE INVENTION

I have invented a roofing tile having a polystyrene core in a tapered configuration, with a notched rear end and narrow nose, covered with aluminum sheet on its top, front and rear surfaces for use on peaked roofs.

My roofing tiles are interlocked together and each joint between laterally adjacent tiles is covered by a gasket strip and a metal sheet to prevent entry of water.

The rear end of the tapered tile has a notch into which is fitted the front end or nose of an abutting tile. An elongated U-shaped metal locking flange is nailed in position over the nose of a tile and a metal L-shaped covering over the rear end of the abutting tile snaps into the U-shaped locking flange to form a connection between each vertically abutting tile.

BRIEF DESCRIPTION OF THE DRAWINGS

The invention may be best understood by those having ordinary skill in the art by reference to the following detailed description when considered in conjunction with the accompanying drawings in which:

FIG. 12 is a perspective view of an elongated U-shaped locking flange for attachment over the nose of a tile.

FIG. 13 is a perspective view of a metal element used to cover a roof hip ridge.

FIG. 14 is a perspective view of a metal element used to cover a roof valley.

FIG. 15 is an exploded view of a metal side sheet engaging a roof tile along a roof eave.

DETAILED DESCRIPTION OF THE INVENTION

Figure 1:
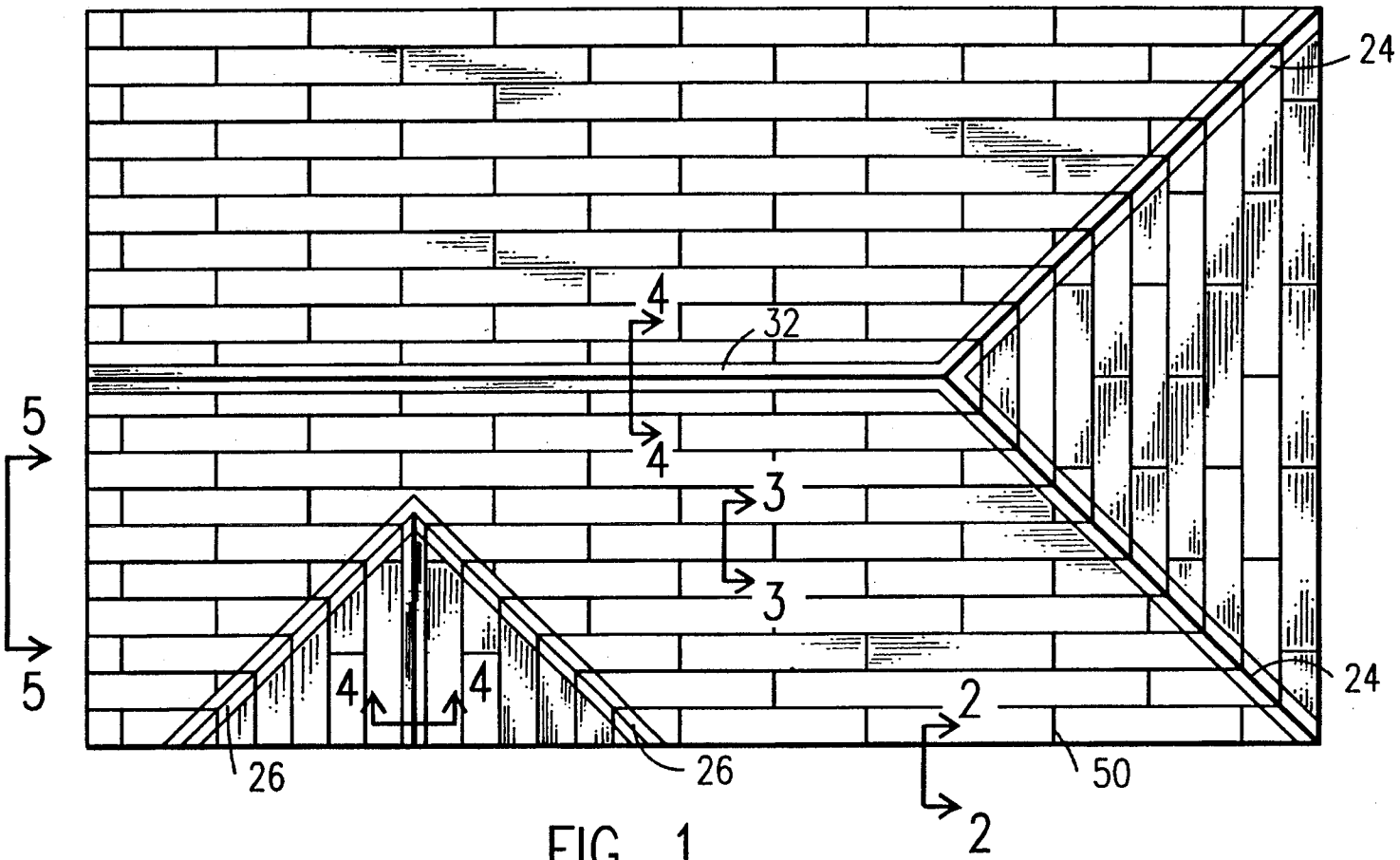
FIG. 1 is a plan view of a peaked roof to which has been applied roofing tiles in accordance with the teaching of this invention.

Throughout the following detailed description, the same reference numerals refer to the same elements in all figures.

Figures 2, 3, 4:
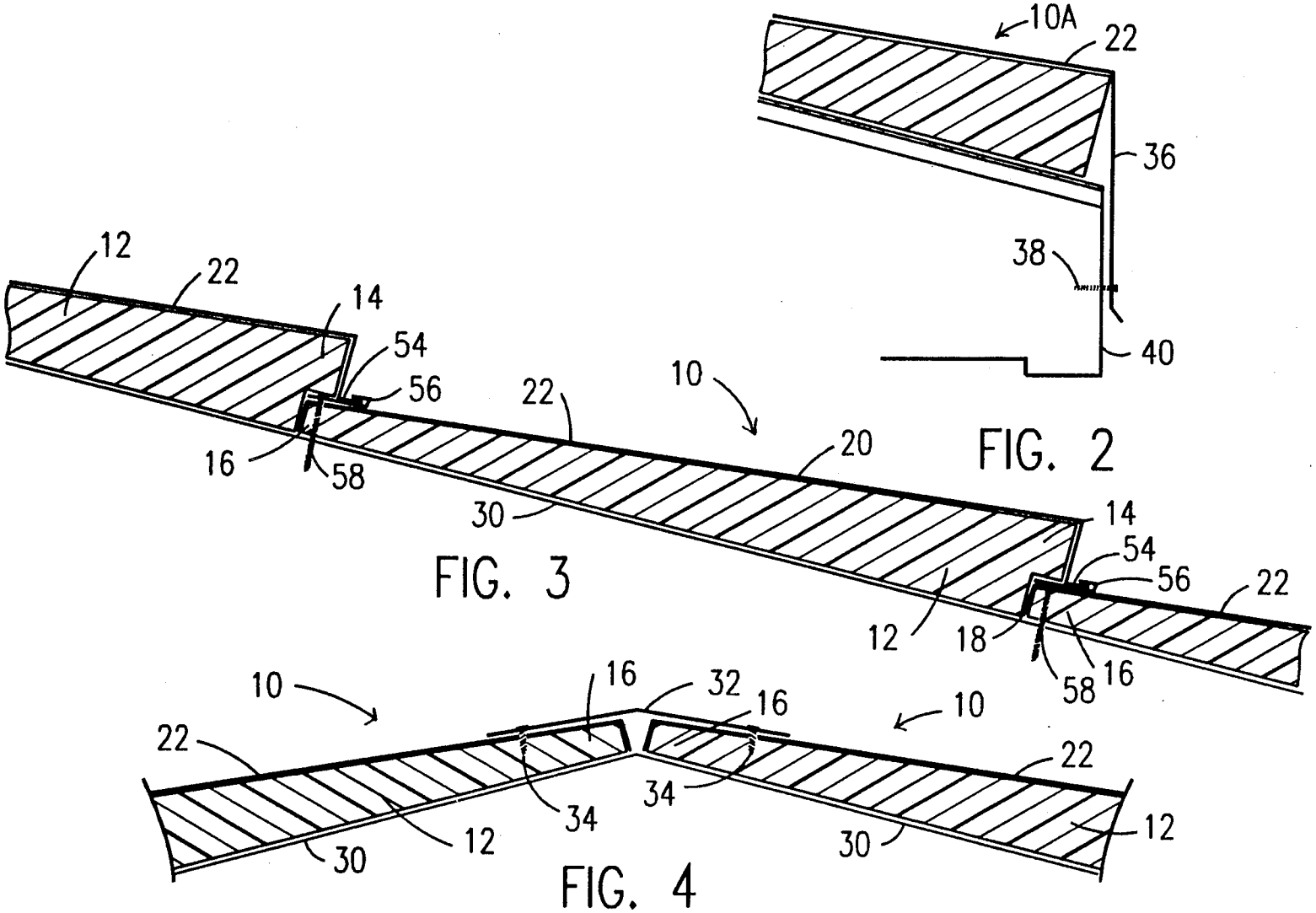
FIG. 2 is a cross-sectional view along lines 2—2 of FIG. 1 showing an eave edge.
FIG. 3 is a cross-sectional view along lines 3—3 of FIG. 1 showing the roofing tiles in rear to nose abutment.
FIG. 4 is a cross-sectional view along lines 4—4 of FIG. 1 showing the roof ridge attachment.

The roof tile 10 shown in FIG. 3 has a polystyrene core 12 and a generally tapered shape from a rear portion 14 to a front nose portion 16. The rear portion 14 has a notched portion 18 to accommodate the nose 16 of another roof tile mounted end to end. The rear portion 14, nose 16 and top surface 20 of each polystyrene core 12 is covered by an aluminum sheet 22. The aluminum sheet 22 is glued to the polystyrene 12. The polystyrene 12 has a one to 1.25 pound density per cubic foot.

As seen in FIGS. 3 and 9–11, the metal sheet 22 has an L-shaped configuration 54 over back portion 14 of the polystyrene core 12. This L-shape configuration or leg 54 fits into a U-shaped locking flange 56 which is screwed 58 in place over the nose 16 of the polystyrene core 12 into the underlying roof structure 30.

Each roof tile 10 can have any reasonable size as required for its intended use. However, a width of ten feet and length of two feet is preferred. The height of the rear portion 14 of the polystyrene 12 is preferably two and a half inches and the nose 16 is one-half inch high at its front. The aluminum sheet 22 is preferably 0.018 gauge and conforms generally to the length and width of the polystyrene core 12. The U-shaped locking flange 56 is made preferably of 0.060 gauge aluminum with spaced apart drain holes 28 as seen in FIG. 12.

Figure 5:
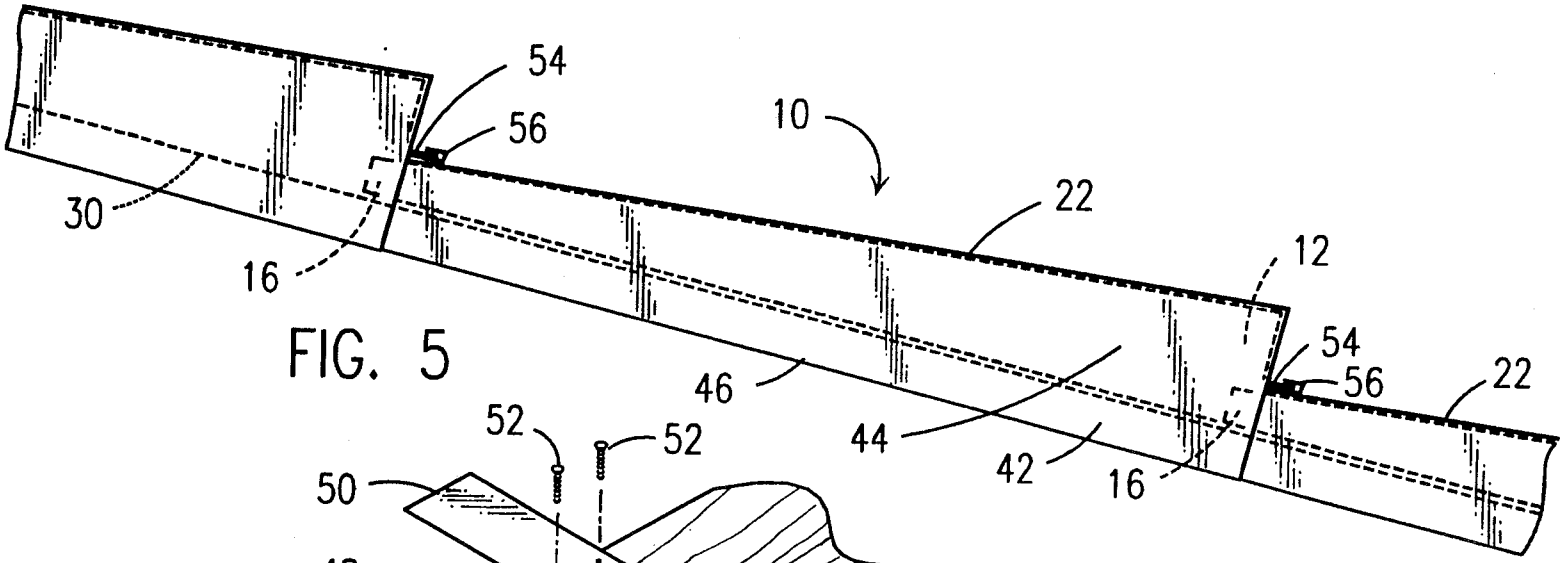
FIG. 5 is a side view partially in phantom along lines 5—5 of FIG. 1 showing a gable end of the roof.

As shown in FIG. 4, the roof ridge is capped by an overlapping aluminum metal sheet 32 which is screwed 34 with a rubber washer sealing off water penetration into the polystyrene. Tile 10 over roof gable edges 42 as seen in FIGS. 5 and 15 has a side 44 of the polystyrene core 12 covered by an aluminum sheet 44 having a skirt portion 46 descending downwardly from the side of the polystyrene core 12 below the roof structure 30.

Figure 6:
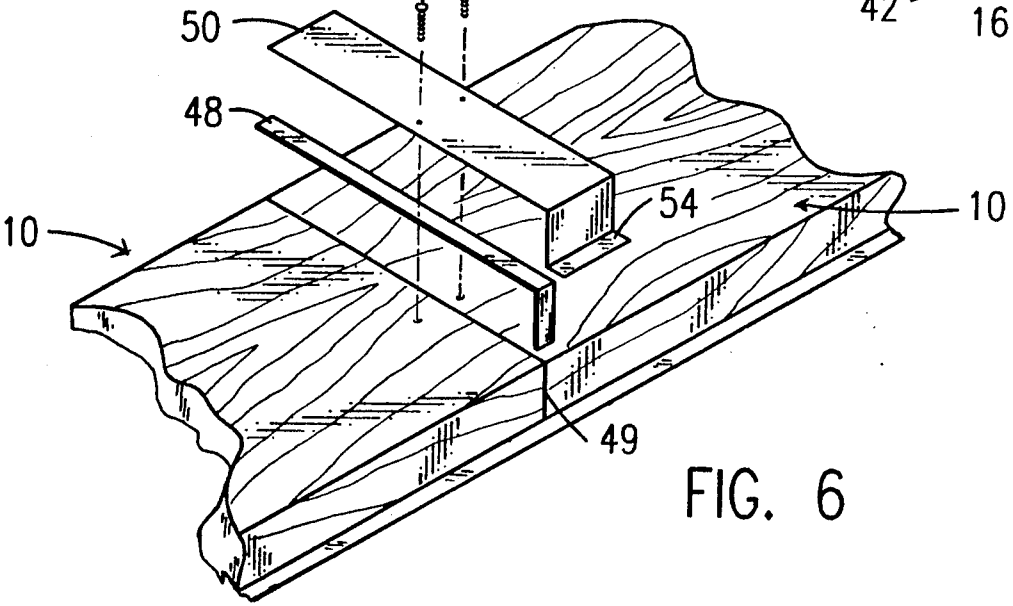
FIG. 6 is a perspective view of a butt joint between two laterally adjacent roofing tiles, partially cut away.

Abutting edges of each roofing tile 10, forming a joint 49 as seen in FIG. 6, are covered by a gasket strip 48. An aluminum sheet 50 covers the gasket strip 48 and is screwed 52 in place.

In applying my roof tiles 10 to an existing roof, a special end tile 10A shown in FIG. 2 having at least a six inch skirt 36 overlaps the eave 40 of a house. The skirt 36 is screwed 38 to the side edge 40 of the roof structure. The nose 16 of the tile 10A fits into a notch 18 in the next vertical tile 10 as seen in FIG. 3. Prior to inserting notch 18 over the nose 16, the U-shaped locking flange 56 is screwed 58 to nose 16 and into the underlying roof 30. L-shaped element 54 slides into the locking flange 56 as notch 18 is placed over nose 16. At the roof ridge, a plate 32 is screwed 34 with rubber washer in place over the nose 16 from two meeting tiles 10 as seen in FIG. 4. Along the side 40 of a roof, a metal sheet 44 covers the side of tile 10 and overlaps the gable edge of the house 42 with skirt 46. As seen in FIG. 6 a gasket sticky tape strip 48 is glued to a seam 49 between abutting panels 10. A metal plate 50 is screwed 52 to the tile 12 to secure the plate 50 in place.

Figure 8:
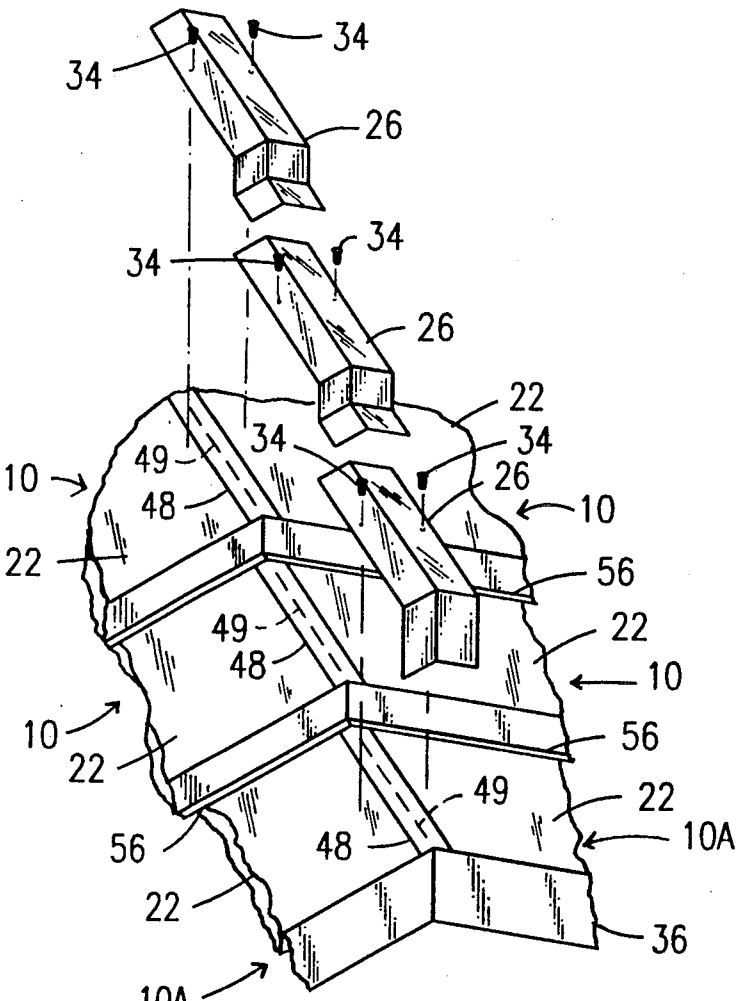
FIG. 8 is a partial exploded perspective view of the roof over a valley.
Figure 7:
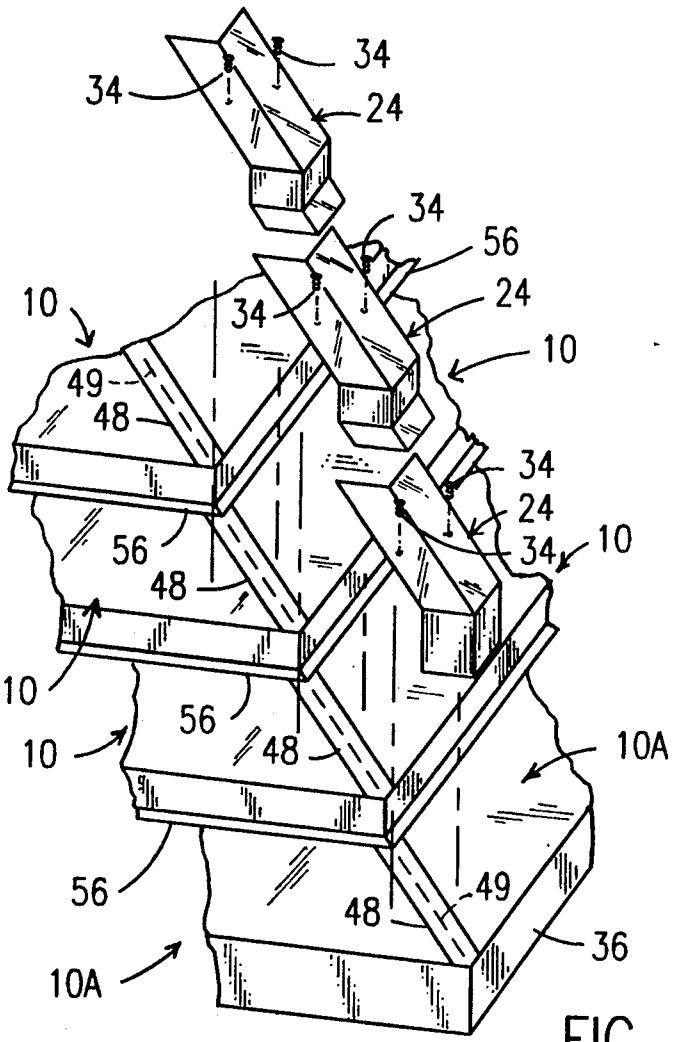
FIG. 7 is a partial exploded perspective view of the roof over a hip ridge.
Figure 9:
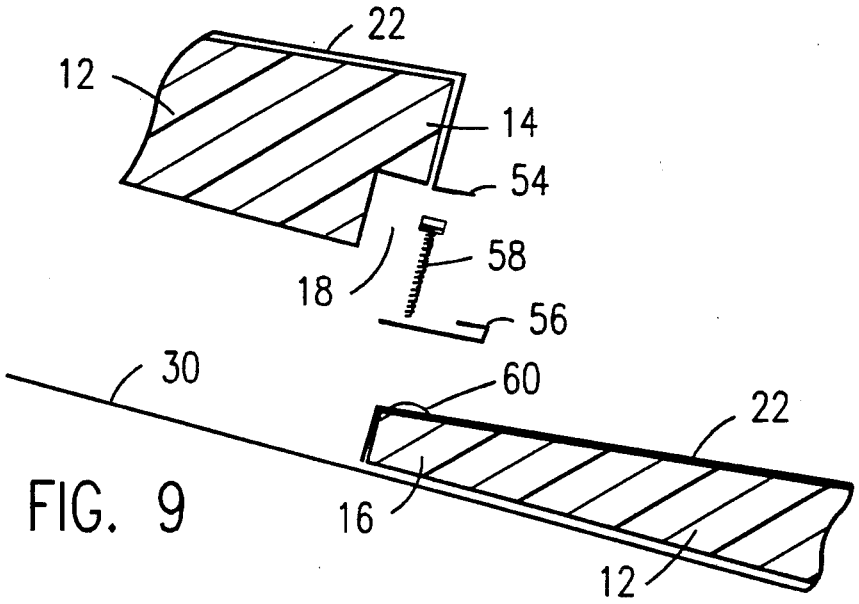
FIG. 9 is an exploded cross-sectional view of the U-shaped locking flange and L-shaped metal joining element prior to their being connected together.
Figure 10:
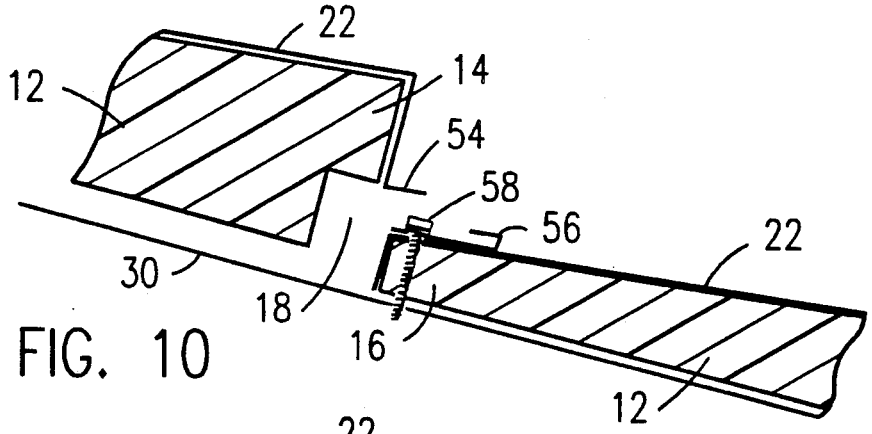
FIG. 10 is a cross-sectional view of the U-shaped locking flange screwed to the nose of a tile prior to snapping in the L-shaped metal joining element.
Figure 11:
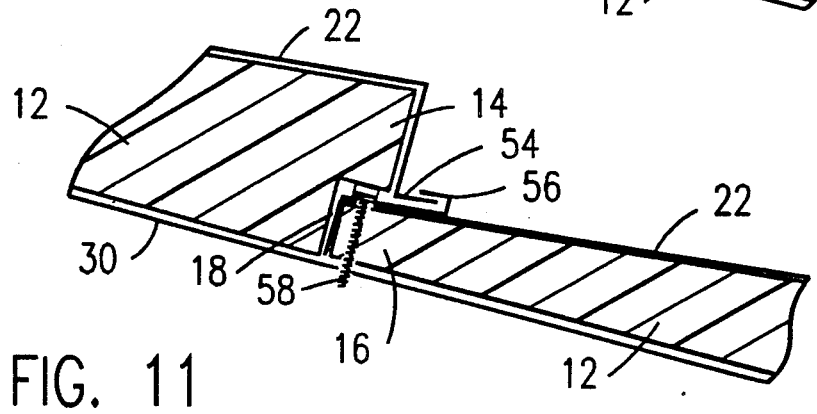
FIG. 11 is an enlarged cross-sectional view of the connection between vertical tiles shown in FIG. 3.

As shown in FIG. 7, a metal strip 24 covers each hip ridge and as shown in FIG. 8 a metal strip 26 covers each roof valley. Each of metal strips 24 and 26 are screwed 34 in place and a gasket strip 48 is secured as shown in FIG. 6 to abutting panels 10.

Construction of my roof system commences with installation of tiles 10A along a roof side and then alternately placed tiles snap into one half of the locking flange 56. This procedure continues upwards to the roof ridge from both sides of the roof. The gasket strips 48 are placed along joints 49 and the aluminum strip 50 is screwed in place over each joint 49. The hip ridges and valleys may require cutting of tiles in a customary manner to finish the roof installation. Preferably a sealant 60 is placed over the nose of the tile 10 to prevent water from intruding under the locking flange 56.

A suitable gasket tape for use in this invention is about four inches wide and is made by Kendall Co., Boston, Mass.

Wind resistance strength of my roofing system exceeds 80 pounds per square inch uplift load.

The aluminum 22 used to cover the polystyrene 12 can have any color or pattern desired by the home owner to create a pleasing look to the roof.

Having thus described the invention, what is claimed and desired to be secured by Letters Patent is:

1. An insulating secondary roof system for installation over an existing peaked roof comprising, a plurality of elongate polystyrene panels covered by a thin sheet of aluminum, a notched rear portion in each panel for positioning over a nose of an adjacent ascending panel, a U-shaped locking flange mounted on the nose of each panel for receipt of an L-shaped leg formed from a portion of aluminum sheet covering the rear portion of each panel, a side seam formed between laterally adjacent panels covered by a gasket tape and the gasket tape covered by an aluminum strip and the nose of meeting panels at a roof ridge covered by an inverted V-shaped metal cap.

2. An insulating secondary roof system according to claim 1 wherein the rear portion of the panel is about two and one-half inches thick and the nose is about one-half inch thick.

3. An insulating secondary roof system according to claim 1 wherein the aluminum sheet is glued to the polystyrene.

4. An insulating secondary roof system according to claim 1 wherein the aluminum sheet is about 0.018 gauge.

5. An insulating secondary roof system according to claim 1 wherein the U-shaped locking flange is mounted to the nose of a panel and through to an underlying roof structure by a screw.

* * * * *